US006085990A

United States Patent [19]

Augustin

[11] Patent Number: 6,085,990

[45] **Date of Patent: *Jul. 11, 2000**

[54] PIEZOELECTRIC INJECTOR FOR FUEL-INJECTION SYSTEMS OF INTERNAL COMBUSTION ENGINES

[75] Inventor: Ulrich Augustin, Kernen, Germany

[73] Assignee: DaimlerChrysler AG, Stuttgart, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/010,831

[22] Filed: Jan. 22, 1998

[30] Foreign Application Priority Data

Jan. 22, 1997 [DE] Germany ..... 197 02 066

[51] Int. Cl.[7] ..... F02M 47/02

[52] U.S. Cl. ..... 239/88; 239/96; 239/397.5; 239/533.8; 239/584; 251/129.06

[58] Field of Search ..... 239/88, 102.2, 239/397.5, 533.8, 584, 96; 251/129.06, 129.14

[56] References Cited

U.S. PATENT DOCUMENTS

| | | | |
|---|---|---|---|
| 3,995,813 | 12/1976 | Bart et al. . | |
| 4,101,076 | 7/1978 | Bart . | |
| 4,284,263 | 8/1981 | Newcomb . | |
| 4,649,886 | 3/1987 | Igashira et al. | 539/584 X |
| 4,669,660 | 6/1987 | Weber et al. | 251/129.06 X |
| 4,690,465 | 9/1987 | Takeda et al. | 251/129.06 X |
| 5,085,399 | 2/1992 | Tsutui et al. | 251/129.06 X |
| 5,094,430 | 3/1992 | Shirai et al. | 251/129.06 |
| 5,156,341 | 10/1992 | Terakado et al. | 239/584.4 |
| 5,632,467 | 5/1997 | Just et al. | 239/585.4 X |

FOREIGN PATENT DOCUMENTS

| | | |
|---|---|---|
| 2306571A | of 1997 | United Kingdom . |
| 9801175 | 3/1998 | United Kingdom . |

OTHER PUBLICATIONS

MTZ Motortechnische Zeitschrift 56 (1995) 3, pp. 142–148.

*Primary Examiner*—Andres Kashnikow
*Assistant Examiner*—Steven J. Ganey
*Attorney, Agent, or Firm*—Evenson, McKeown, Edwards & Lenahan, P.L.L.C.

[57] ABSTRACT

A piezoelectric injector for fuel-injection systems of internal combustion engines has a piezoactuator guided with spring pretensioning in a valve housing. The actuator presses a sealing piece onto its valve seat through an actuating part, with the actuating part consisting of a pressure pin passing through the piezoactuator and having a head part resting on piezoactuator. The pressure pin and piezoactuator are of the same length and are made of the same ceramic material, in operation the sealing piece is lifted off its valve seat by piezoactuator which is expanded when in the charged state.

20 Claims, 2 Drawing Sheets

PIEZOELECTRIC INJECTOR FOR FUEL-INJECTION SYSTEMS OF INTERNAL COMBUSTION ENGINES

This application claims the priority of German application 197 02 066.6-13 filed in Germany on Jan. 22, 1997, the disclosure of which is expressly incorporated by reference herein.

BACKGROUND AND SUMMARY OF THE INVENTION

The invention relates to a piezoelectric injector for fuel-injection systems of internal combustion engines.

In piezoelectric injectors, the thermal expansion of housing parts of the piezoactuator roughly corresponds to the working stroke of the piezoactuator. On the other hand the thermal expansion of piezomaterials is approximately zero. Therefore, it is known that hydraulic compensating members or housing combinations made of materials with different thermal expansion values are used.

From MTZ Motortechnische Zeitschrift 56 (1995) 3, pages 142–148, FIG. 8, a piezoelectric injector with a rod-shaped piezoactuator is known which closes an injection nozzle drilled in a seat bore in the expanded, i.e. charged state. The high pressure that prevails at this point is metered by the nozzle needle when the actuator discharges. The tensioning of the system can be adjusted by cup springs. The pretensioning force must be high enough for the nozzle to seal off the full fuel pressure with the actuator charged.

The low thermal expansion of the piezoceramic is partially compensated by a combination of CFCs (chlorofluorocarbons) and metal in the injector housing.

In piezoelectric injectors of this type, the direction of movement of the piezoactuator when subjected to flow is opposite that of conventional solenoid valves.

A goal of the invention is to improve the piezoelectric injector of the type referred to above specifically with regard to a simpler design in which the valve housing can consist of materials such as steel or aluminum without the thermal expansions of these materials exerting an unfavorable influence on the accuracy of the valve strokes.

This goal is achieved by providing a piezoelectric wherein the actuating part comprises a pressure pin that passes through the piezoactuator, with a head part resting on the piezoactuator, wherein the pressure pin and piezoactuator are of approximately the same length and are made of similar characteristic thermal expansion ceramic material or ceramic-like material, and wherein sealing piece can be lifted off its valve seat by piezoactuator which is extended when in the charged state.

The special arrangement and location of the actuating part in the piezoelectric injector as well as the motion reversal of the piezoactuator when subjected to flow permits a simple design which, despite the additional use of materials such as steel or aluminum conventionally employed in valve housings, causes no adverse effects on function as far as exact valve strokes are concerned.

The lengthwise expansions that unavoidably occur under thermal loads thus do not produce any negative effect on the unimpeded closing function of the valve.

In addition, if there is an electrical defect in the injector, there is no leakage at the nozzle, which can lead to engine damage, especially in high-pressure systems using the common rail principle, because the nozzles no longer close, said nozzles opening or closing depending on the position of the sealing piece cooperating with a control piston on the back of the nozzle needle in the piezoelectric injector.

The pressure pin and piezoactuator that have the same length and are made of the same ceramic material can also consist of a ceramic material, Invar for example.

Figure 1:
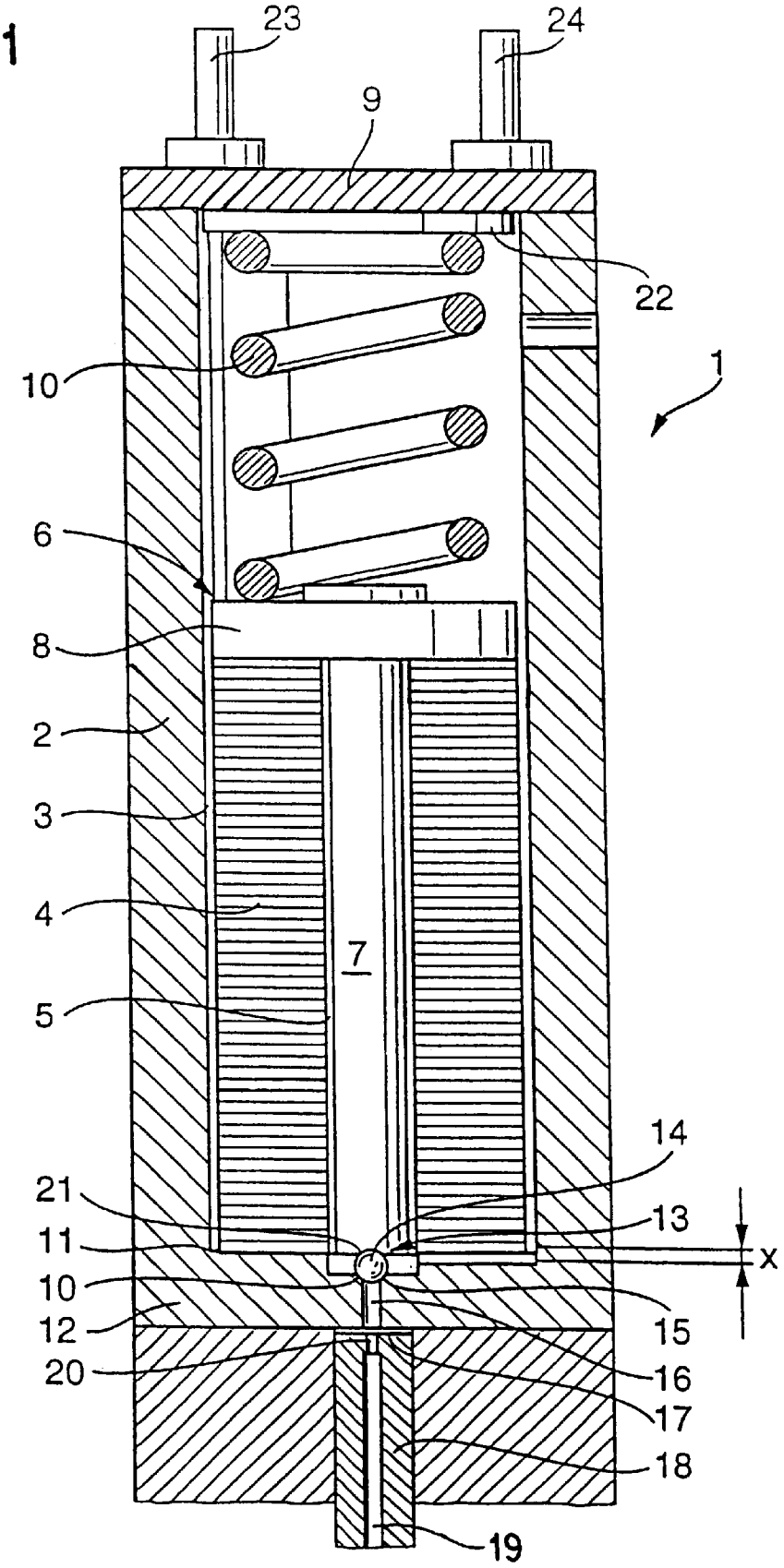
FIG. 1 is a schematic side view of a piezoelectric injector comprising a piezoactuator according to the present invention.

Other objects, advantages and novel features of the present invention will become apparent from the following detailed description of the invention when considered in conjunction with the accompanying drawings.

BRIEF DESCRIPTION OF THE DRAWINGS

A piezoelectric injector 1 for fuel-injection systems of internal combustion engines, especially for high-pressure systems designed as common rail systems, comprises a spring-loaded piezoactuator 3 located in a valve housing 2.

Piezoactuator 3 is designed as an annular piezoelement 4, said elements being stacked on top of one another and forming a continuous central cavity 5, leaving space for an actuating part 6. This actuating part 6 is composed of a pressure pin 7 and a head part 8, with head part 8 that resembles an external bead resting on piezoactuator 3 and with pressure pin 7 passing all the way through piezoactuator 3.

Between piezoactuator 3 and a closure 9 resembling a lid on valve housing 2, a pretensioned compression spring is provided, said spring abutting head part 8 of actuating part 6 and pressing piezoactuator 3 against housing surface 11 of a narrowed housing part 12 at the lower end of valve housing 2 and also pressing pressure pin 7, which fits flush against housing surface 11, against a closure 13.

Piezoactuator 3 and pressure pin 7 are of the same length and are made of the same ceramic material.

Closure 13 is formed by a valve ball 14, said ball resting on a conical valve seat 15. Valve seat 15 communicates through a bore 16 in housing part 12 of injector 1 with a pressure chamber 17 above a control piston 18, said piston being charged through a channel 19 and a feed throttle 20 with high pressure from a supply line (rail) that is not described in greater detail and that serves as a high-pressure supply for all the injectors.

A valve ball 14 is held in place by a recess 21 that is roughly hemispherical in shape.

A spacing washer 22 is located between lid-like closure 9 of valve housing 2 and head part 8 of actuating part 6, by means of which washer the spring pretensioning can be adjusted.

In the vicinity of narrowed housing part 12, the voltage guides that lead to piezoactuator 3 (not shown) are located, said guides being connected in a conducting fashion with outer terminals 23 and 24.

Figure 2A:
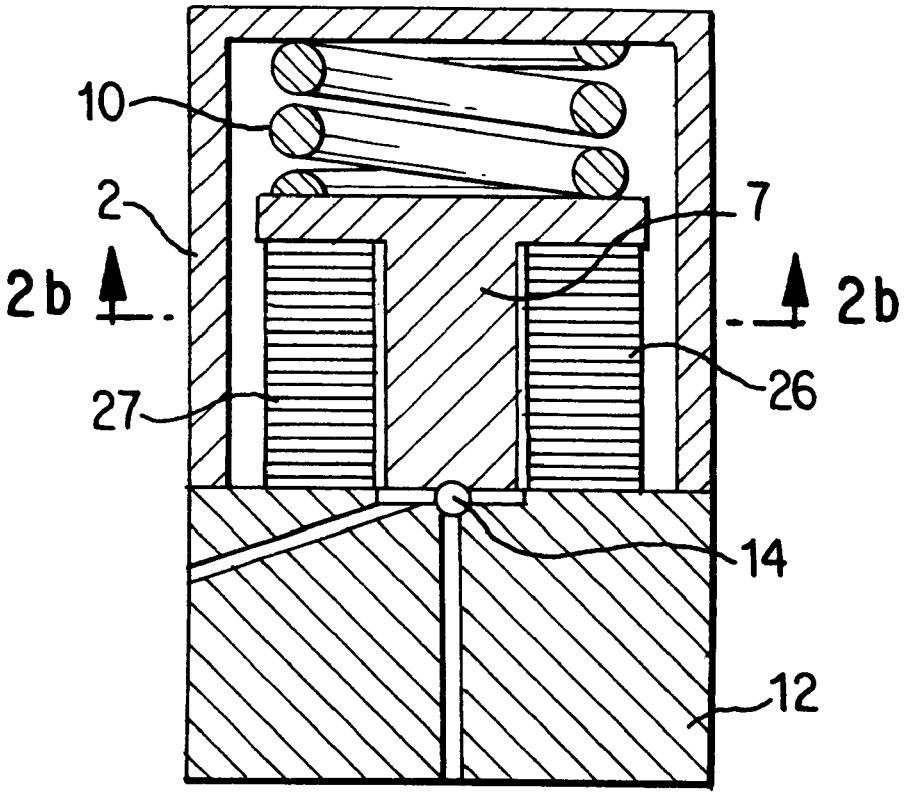
FIG. 2*a* is a schematic side view of a piezoelectric injector comprising a piezoactuator consisting of two small actuators located side by side and having a pressure pin that extends between them.
Figure 2B:
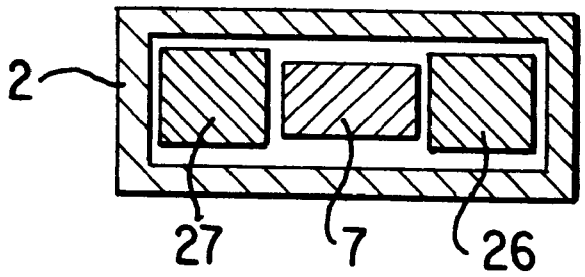
FIG. 2*b* is a top view of the piezoelectric injector of FIG. 2*a* along the A—A line.

Piezoactuator 3 composed of annular piezoelements 4 may also consist of two projecting actuators (26, 27) located side by side with a space between them FIGS. 2*a* and 2*b*, between which actuators pressure pin 7 runs, said pin having the same length as the two actuators. The pressure pin can be connected by a bridge with the actuators rather than by a head part that resembles an external bead.

In addition, a spacing washer not shown in greater detail can be provided between piezoactuator 4 and housing area 11 of narrowed housing part 12, with the compressive stress of pressure pin 7 in the closed state being adjustable by said washer.

The piezoelectric injector operates as follows:

As a result of a voltage signal, pretensioned piezoactuator 3 expands or lengthens against the force of compression spring 10. As a result, valve ball 14 is opened by pressure pin 7 whose length is unchanged, and pressure chamber 17 is relieved through control piston 18. Control piston 18 can move upward and lift a nozzle needle (not shown) off its valve seat. A critical factor for moving the valve ball with ball travel x is the relative movement between piezoactuator 3 and pressure pin 7 in the vicinity of housing area 11 of radially narrowed housing part 12. The thermal expansion that occurs during temperature changes in the elongate valve housing has no influence whatever.

Thus, by virtue of the measures according to the invention, regardless of any other temperature influences, exact valve travels are possible, and when the valve ball is in the closed position, a perfect sealing seat is ensured.

In addition, the level of the control signal can control the valve travel so that a variable drain restriction can be provided.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A piezoelectric injector for fuel-injection systems of internal combustion engines, comprising:

a piezoactuator guided under spring pretensioning in a valve housing, wherein an actuating part comprises a pressure pin that passes through the piezoactuator and a head part resting on the piezoactuator, said actuating part pressing a sealing piece against a valve seat thereby closing a bore leading to a pressure chamber, wherein the pressure pin and the piezoactuator are of approximately the same length and are made of similar thermal expansion characteristic ceramic material or ceramic-like material, and wherein the sealing piece can be lifted off its valve seat by the piezoactuator which is extended when in the charged state.

2. Piezoelectric injector according to claim 1, wherein the piezoactuator is composed of annular piezoelements in which the pressure pin of actuating part is concentrically located.

3. Piezoelectric injector according to claim 2, wherein the head part of the actuating part that rests on the piezoactuator and an upper lid-type closure of the valve housing form supporting bodies for a compression spring.

4. Piezoelectric injector according to claim 3, wherein a separate spacing washer is located between the lid-like closure and a spring end of the compression spring.

5. Piezoelectric injector according to claim 1, wherein piezoactuator abuts a lower housing surface of a narrowed housing part of the valve housing, and wherein the pressure pin of the actuating part ends flush with the piezoactuator in a vicinity of this lower housing surface when the sealing piece is in a closed position.

6. Piezoelectric injector according to claim 5, wherein sealing piece is designed as a valve ball that is secured in position in a recess in the pressure pin that is approximately hemispherical in shape.

7. Piezoelectric injector according to claim 6, wherein the head part of the actuating part that rests on the piezoactuator and an upper lid-type closure of the valve housing form supporting bodies for a compression spring.

8. Piezoelectric injector according to claim 7, wherein a separate spacing washer is located between the lid-like closure and a spring end of the compression spring.

9. Piezoelectric injector according to claim 5, wherein the head part of the actuating part that rests on the piezoactuator and an upper lid-type closure of the valve housing form supporting bodies for a compression spring.

10. Piezoelectric injector according to claim 9, wherein a separate spacing washer is located between the lid-like closure and a spring end of the compression spring.

11. Piezoelectric injector according to claim 1, wherein the head part of the actuating part that rests on the piezoactuator and an upper lid-type closure of the valve housing form supporting bodies for a compression spring.

12. Piezoelectric injector according to claim 11, wherein a separate spacing washer is located between the lid-like closure and a spring end of the compression spring.

13. A piezoelectric injector according to claim 1, wherein the valve housing comprises steel or aluminum.

14. Piezoelectric injector for fuel-injection systems of internal combustion engines, comprising:

a piezoactuator guided under spring pretensioning in a valve housing, wherein the piezoactuator consists of two small actuators located side by side, wherein an actuating part comprises a pressure pin that extends between the actuators, with the pressure pin being coupled by a bridge that connects the two actuators, said actuating part pressing a sealing piece against a valve seat thereby closing a bore leading to a pressure chamber, wherein the pressure pin and the actuators are of approximately the same length and are made of similar thermal expansion characteristic ceramic material or ceramic-like material, and wherein the sealing piece can be lifted off its valve seat by the piezoactuator which is extended when in the charged state.

15. Piezoelectric injector according to claim 14, wherein piezoactuator abuts a lower housing surface of a narrowed housing part of the valve housing, and wherein the pressure pin of the actuating part ends flush with the piezoactuator in a vicinity of this lower housing surface when the sealing piece is in a closed position.

16. Piezoelectric injector according to claim 15, wherein sealing piece is designed as a valve ball that is secured in position in a recess in the pressure pin that is approximately hemispherical in shape.

17. Piezoelectric injector according to claim 16, wherein the head part of the actuating part that rests on the piezoactuator and an upper lid-type closure of the valve housing form supporting bodies for a compression spring.

18. Piezoelectric injector according to claim 17, wherein a separate spacing washer is located between the lid-like closure and a spring end of the compression spring.

19. Piezoelectric injector according to claim 14, wherein the head part of the actuating part that rests on the piezoactuator and an upper lid-type closure of the valve housing form supporting bodies for a compression spring.

20. Piezoelectric injector according to claim 19, wherein a separate spacing washer is located between the lid-like closure and a spring end of the compression spring.

* * * * *